US007900719B2

(12) United States Patent
Yao

(10) Patent No.: US 7,900,719 B2
(45) Date of Patent: Mar. 8, 2011

(54) BI-STEEL PERCUSSIVE DRILL ROD

(75) Inventor: Jing James Yao, Mississauga (CA)

(73) Assignee: Longyear TM, Inc., South Jordan, UT (US)

( * ) Notice: Subject to any disclaimer, the term of this patent is extended or adjusted under 35 U.S.C. 154(b) by 64 days.

(21) Appl. No.: 12/427,562

(22) Filed: Apr. 21, 2009

(65) Prior Publication Data

US 2009/0266615 A1 Oct. 29, 2009

Related U.S. Application Data

(60) Provisional application No. 61/047,154, filed on Apr. 23, 2008.

(51) Int. Cl.
*E21B 17/20* (2006.01)

(52) U.S. Cl. ..... 175/320

(58) Field of Classification Search ..... 175/320
See application file for complete search history.

(56) References Cited

U.S. PATENT DOCUMENTS

| | | | | |
|---|---|---|---|---|
| 3,295,613 | A * | 1/1967 | Anderson | 173/131 |
| 4,043,409 | A * | 8/1977 | Walter | 175/321 |
| 4,826,542 | A | 5/1989 | Borodin | |
| 4,859,542 | A | 8/1989 | Begg et al. | |
| 4,911,625 | A | 3/1990 | Begg et al. | |
| 5,788,401 | A | 8/1998 | Drenth | |
| 5,919,578 | A | 7/1999 | Lundell | |
| 5,988,301 | A | 11/1999 | Lundell | |
| 6,095,266 | A | 8/2000 | Lundell | |
| 6,109,620 | A * | 8/2000 | Roberts et al. | 279/143 |
| 6,196,598 | B1 | 3/2001 | Yao | |
| 7,182,159 | B2 * | 2/2007 | Linden | 175/320 |
| 2004/0226754 | A1 | 11/2004 | Nordfeldt | |
| 2005/0217901 | A1 | 10/2005 | Hedlund et al. | |

FOREIGN PATENT DOCUMENTS

| | | | |
|---|---|---|---|
| EP | 0260850 | A2 | 3/1988 |
| JP | 05-002881 | U | 1/1993 |
| JP | 07-090470 | B2 | 10/1995 |
| JP | 3129177 | U | 1/2007 |
| KR | 20-0390348 | U | 7/2005 |
| WO | 2004029403 | A1 | 4/2004 |

OTHER PUBLICATIONS

International Search Report and Written Opinion dated Nov. 2, 2009 as issued in International Application No. PCT/US2009/041374 filed Apr. 22, 2009.

William D. Callister, Jr., Fundamentals of Materials Science and Engineering, pp. 332-334, 481 (Wayne Anderson 5th ed., John Wiley & Sons, Inc., 2001).

* cited by examiner

*Primary Examiner* — William P Neuder
(74) *Attorney, Agent, or Firm* — Workman Nydegger

(57) ABSTRACT

A drill rod includes a first end section, a mid-section, wherein the first end section and the mid-section are connected and wherein the first end section is manufactured using different steel than is used for the mid-section. Such a configuration can reduce the costs associated with forming a drill rod while maintaining the functionality of such a drill rod.

21 Claims, 4 Drawing Sheets

BI-STEEL PERCUSSIVE DRILL ROD

CROSS-REFERENCE TO RELATED APPLICATIONS

The present application claims the benefit of U.S. Provisional Patent Application Ser. No. 61/047,154 filed Apr. 23, 2008 entitled Bi-Steel Percussive Drill Rods, which is hereby incorporated by reference in its entirety.

BACKGROUND OF THE INVENTION

1. The Field of the Invention

The present invention relates generally to drill rods, such as drill rods for percussive drilling, and their method of manufacture. More specifically, the present invention relates to bi-steel percussive drill rods.

2. Related Technology

Drill rods are known in the art and are used in drilling operations including percussive drilling. In percussive drilling, drill rods and other drill components are subject to high levels of impact, local-working, and bending stresses associated with the drilling process. Accordingly, structural steels can be employed in the manufacture of drill rods to withstand the associated stresses. However, these structural steels can contain expensive alloying elements such as nickel to achieve the desired mechanical properties. While alloying materials were once available more abundantly, supplies are now strained by high demand. As a result, the prices of alloying elements are ever increasing, causing the cost of manufacturing drilling components such as drill rods to increase as well. This, in turn, presents a financial burden for drilling companies and manufacturers.

BRIEF SUMMARY

A drill rod includes a first end section, a mid-section, wherein the first end section and the mid-section are connected and wherein the first end section is manufactured using a different steel than is used for the mid-section. Such a configuration can reduce the costs associated with forming a drill rod while maintaining the functionality of such a drill rod.

A method of manufacturing a drill rod can include forming a first end section of the drill rod from a high-grade structural steel, forming a mid-section of the drill rod from an at least partially bainitic steel, and joining the first end section and the mid-section.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present disclosure, a more particular description will be rendered by reference to specific embodiments thereof which are illustrated in the appended drawings. It is appreciated that these drawings depict only typical examples and are therefore not to be considered limiting of the disclosure's scope. Examples will be described and explained with additional specificity and detail through the use of the accompanying drawings in which.

DETAILED DESCRIPTION

Figure 1:
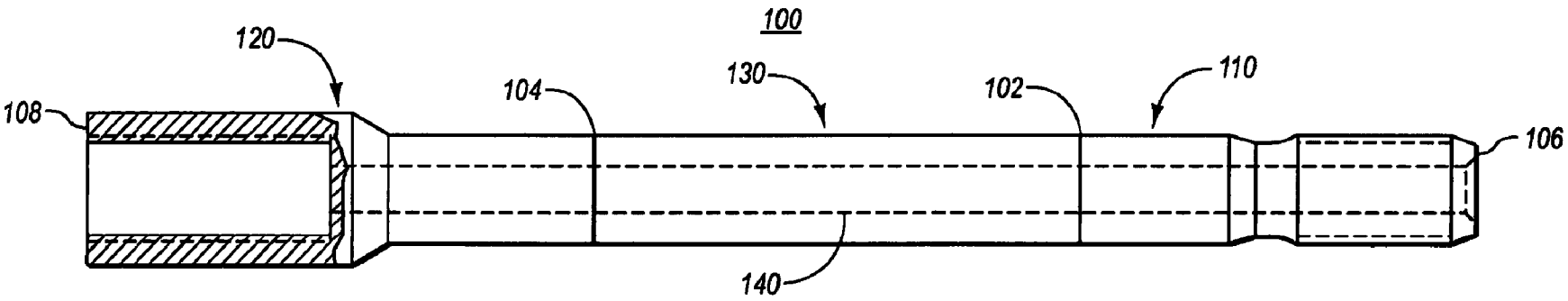
FIG. 1 illustrates a side view of a drill rod according to one example.

Bi-steel percussive drill rods and methods of manufacturing the same are provided herein in which high-grade structural steel can be used to manufacture at least one of the two ends of the drill rod and less expensive steel can be used to manufacture the middle of the drill rod. Such a configuration may reduce the cost associated with the drill rod and its manufacture without compromising the overall performance or expected lifespan of the drill rod.

In the following detailed description, reference is made to the accompanying drawings which form a part hereof, and in which are shown by way of illustration specific examples may be practiced. It is to be understood that other examples may be utilized and structural changes may be made without departing from the scope of the present disclosure.

In percussive drilling, including what is known as top-hammer percussive drilling, drill rods can be subject to high levels of impact, bending, and/or local-working stresses. In order to withstand the stresses associated with the drilling process, percussive drill rods can be manufactured using high-grade structural steel. These structural steels are able to obtain the desired strengths and other mechanical properties by using alloying elements, such as nickel. For example, EN27 grade steel is currently used in many top-performing drill rods and normally contains 2.5-3.0 wt % of nickel and is heat treated to a tempered martensitic structure. While alloying materials were previously more freely available, growing demand has caused the prices of these alloying materials to continually increase. This has presented a financial burden for drill rod manufacturers and drilling companies.

Drill rods and methods of manufacturing the same that are provided herein may provide a low-cost alternative to constructing drill rods entirely out of expensive alloy steels. Many normal failures in drill rods occur at the ends where the local-working stress level is much greater than the stresses experienced along the mid-section of the drill rod. These stresses may include the stresses associated with driving the rod using a rig or other driving device and stresses associated with the bit as the bit works. Accordingly, the life of a drill rod can be dictated by the strength of the ends. However, the size of the mid-section of a drill rod can comprise a majority of the mass of the drill rod. As a result, the cost of drill rods may be significantly increased by the use of expensive, high-grade structural steel for the entire drill rod. Accordingly, the high cost of drill rods can be at least partly due to an inefficient use of expensive high-grade structural steel for the entire drill rod even though the mid-section of the drill rod may be subject to lower impact and bending stresses than those experienced at the ends.

By replacing at least a portion of the mid-section of the drill rod with a lower-cost steel capable of withstanding the impact and bending loads of the mid-section, while maintaining use of higher grade structural steel for the ends where the local-working stress levels are greatest, the drill rods and methods of manufacture the same described below can reduce the cost of drill rods without comprising the performance or lifespan of the drill rods.

Reference is now made to FIG. 1, which illustrates a side view of a drill rod 100 according to one example. In the illustrated example, the drill rod 100 includes a first end section 110, a second end section 120, and a mid-section 130. A first connection 102 joins the first end section 110 to the mid-section 130. A second connection 104 joins the second end section 120 to the mid-section 130. In the illustrated embodiment, the drill rod 100 has a bit end 106 (i.e. the end of the drill rod 100 closest to a drill bit or to the bottom or end of a hole being drilled) and a rig end 108 (i.e. the end closest to the drill rig to which the drill rod 100 is coupled). For ease of reference, the bit end and rig end will also be used in discussing various parts of individual components below.

The outside diameter of the drill rod 100 may be cylindrical or hexagonal in shape. Alternatively, the outside diameter of the drill rod 100 may be shaped in accordance with any desired drill rod shape. The drill rod 100 may include a flushing hole 140 defined therein that may extend through the length of the drill rod 100 that allows transportation of a flushing medium during the drilling process. The shape and size of the flushing hole 140 may be continuous or may vary along the length of the drill rod 100.

The first end section 110 and the second end section 120 can be constructed of any high grade structural steel capable of withstanding the local-working stresses experienced at the ends of the drill rod 100. For example, EN27 grade steel and/or high nickel chromium molybdenum steels can be used. In one example, the drill rod 100 may undergo a carburizing cycle typical of the steel used for the end sections 110 and 120 after the first end section 110 and/or the second end section 120 have been joined to the mid-section 130. In other examples, the first end section 110 and second end section 120 may be pre-hardened before being connected to the mid-section 130. The first and second end sections 110 and 120 may also be subject to local hardening, such as high-frequency induction hardening, after being connected to the mid-section. The lengths of the first and second end sections 110 and 120 can be less than the length of the mid-section 130. As such, the mid-section 130 can represent the majority of the mass of the drill rod 100.

Because the mid-section 130 can comprise the majority of the mass of the drill rod 100 while not being subject to the same stresses experienced by the end sections 110 and 120 of the drill rod 100, it can be beneficial to construct the mid-section 130 using lower-cost steel than the steel used for the end sections 110 and 120. Therefore, the steel for the mid-section steel can be made without using the same expensive alloying elements, or without using the same quantities of expensive alloying elements, as used in many higher-grade structural steels. As a result, the drill rod can be manufactured at an overall lower cost than drill rods with comparable mechanical properties manufactured using a single steel.

One example of low-cost steel that may be capable of withstanding the stresses of the mid-section is bainitic steel. Although bainitic steels may not match the performance of the higher grade structural steels discussed above, commercial grade bainitic steels can be manufactured with sufficient strength to withstand the impact and bending stresses experienced at the mid-section of percussive drill rods and at a lower cost than higher grade structural steels. One embodiment of the invention can include manufacturing the mid-section 130 of the drill rod 100 using a bainitic steel having the following contents:

| | Element | | | | | | |
|---|---|---|---|---|---|---|---|
| | C | Si | Mn | Cr | Mo | P, S | Cu |
| Wt % | 0.16-0.22 | 1.1-1.4 | 1.9-2.3 | 0.8-1.1 | 0.25-0.35 | ≦0.020 | ≦0.2 |

Similarly, additional bainitic or partially-bainitic steels can also be used to manufacture the mid-section 130. Furthermore, any steel capable of withstanding the stresses experienced by the mid-section 130 of the drill rod 100, yet having a cost lower than steels necessary to withstand the stresses experienced by the end sections 110 and 120, may be used.

In one implementation of the present disclosure, the steel used for the mid-section can be readily weldable to EN27 steel. The grain size of the steel used for the mid-section may not grow significantly during the carburization cycle of the drill rod. In one implementation, the drill rod is cooled after the carburization cycle by forced air cooling, after which the microstructure of the steel used for the mid-section should be mainly bainite rather than martensite. In an additional implementation, the high carbon content (greater than 0.5% by weight percentage) in the carburized case of the mid-section after the carburization cycle does not cause severe detrimental effects such as reduced fatigue strength or increased brittleness and the like. Furthermore, the case depth of the mid-section can be equal or close to the case depth in the end sections. In one example, the hardness profile of the drill rod can be substantially symmetrical across a connection between the mid-section and an end section.

In an additional implementation, some of the cost savings achieved by using a lower cost steel for the mid-section may be used to upgrade the steel used for the end sections, thereby increasing the performance and strength of the drill rod as a whole while still decreasing the overall cost of the drill rod.

Figure 2:
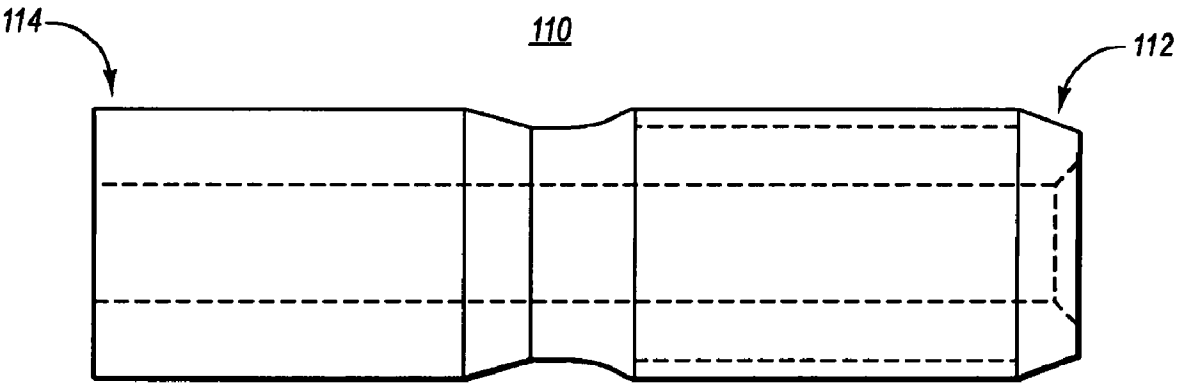
FIG. 2 illustrates a first end section of the drill rod of FIG. 1.

With continuing reference to FIG. 1, reference is now further made to FIG. 2, which illustrates the first end section 110 of the drill rod 100. The first end section 110 is located at the bit end 106 of the drill rod 100. The first end section 110 of the drill rod 100 can be configured to be coupled with additional drill rods or other drill components, such as a drill bit. In particular, in one example a bit end 112 of the first end section 110 can be configured to the first end section 110 to additional drill rods and other drill components. For example, the bit end 112 may be configured as and/or include a male-type interface that is configured to be coupled to female-type interface in an associated drill component. The bit end 112 of the first end section 110 may also optionally include external threading to facilitate coupling or communication with internal threading of an associated drill rod or other drill component. The first end section 110 may also include any other external shaping that would facilitate coupling with additional drill rods or other drill components, such as being star-shaped, gear-shaped, hexagonally-shaped, and the like.

The first end section 110, and a rig end 114 in particular, is configured to be connected to the mid-section 130 of the drill rod 100. In one embodiment, the first end section 110 can be connected to the mid-section 130 using a friction welding process. However, additional processes may be used for connecting the first end section 110 to the mid-section 130 without departing from the intent or scope of the present invention.

Figure 3:
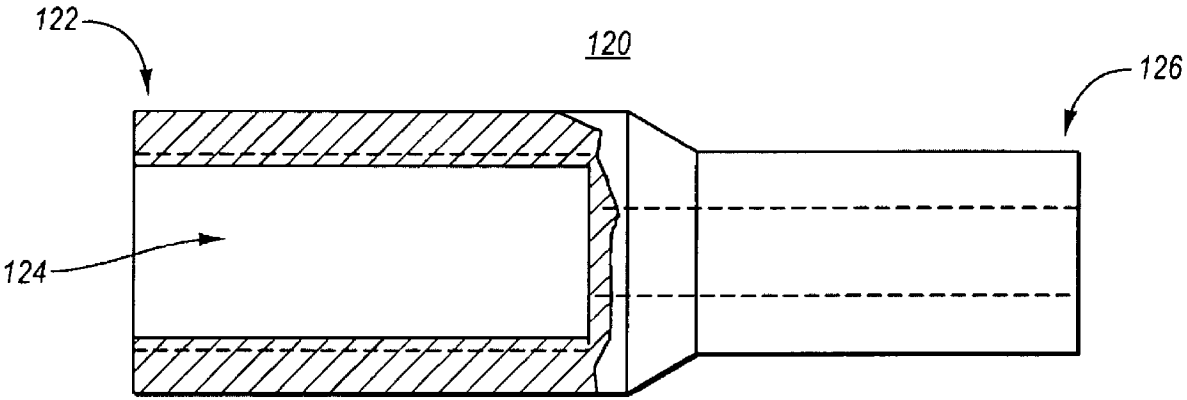
FIG. 3 illustrates a second end section of the drill rod of FIG. 1.

With continuing reference to FIG. 1, reference is now made to FIG. 3, which illustrates the second end section 120 of the drill rod 100. In the illustrated embodiment, the second end section 120 is located at the rig end 108 of the drill rod 100. The second end section can also be configured to be coupled with additional drill rods or other drill components. In one embodiment, a rig end 122 of the second end section 120 can be configured to be coupled to other drill rods and/or components. For example, the rig end 122 may include a recess 124 defined therein. The recess 124 can be shaped as a female adapter and configured to receive corresponding male adapters of additional drill rods and other drill components. In an additional embodiment, the rig end 122 of the second end section 120 can further include internal threading to facilitate communication with external threading of another drill rod or other drill component. The second end section 120 may alternatively be shaped in any way that would facilitate coupling with additional drill rods or other drill components, such as being star-shaped, gear-shaped, hexagonally-shaped, and the like. In one embodiment, multiple drill rods 100 can be connected together to form a drill string in which first end sections 110 are coupled with second end sections 120. The drill string can further be coupled to a drill rig at one end and to a drill bit at the other end.

A bit end 126 of the second end section 120 is configured to be connected to the mid-section 130 of the drill rod 100. In one embodiment, the second end section 120 can be connected to the mid-section 130 using a friction welding process. However, additional processes may be used for connecting the second end section 120 to the mid-section 130 as desired.

Figure 4:
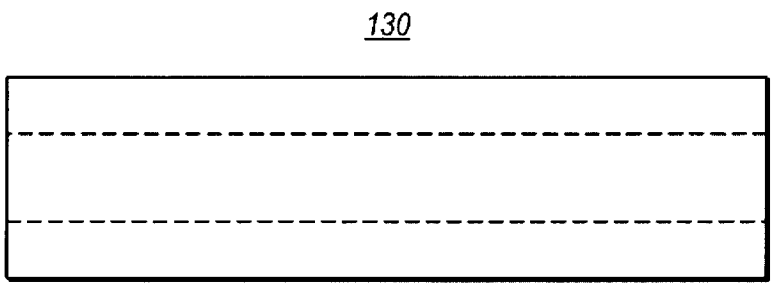
FIG. 4 illustrates a mid-section of the drill rod of FIG. 1.

With continuing reference to FIG. 1, reference is now made to FIG. 4, which illustrates the mid-section 130 of the drill rod 100. In the illustrated embodiment, the mid-section 130 can be connected to the first end section 110 at connection 102 and to the second end section 120 at connection 104. In one embodiment the outside diameter of the mid-section 130 can be equal to the outside diameter of the first and second end sections 110 and 120. In alternative embodiments, the outside diameter of the mid-section 130 can be greater than or less than the outside diameters of the first and second end sections 110 and 120.

Figure 5:
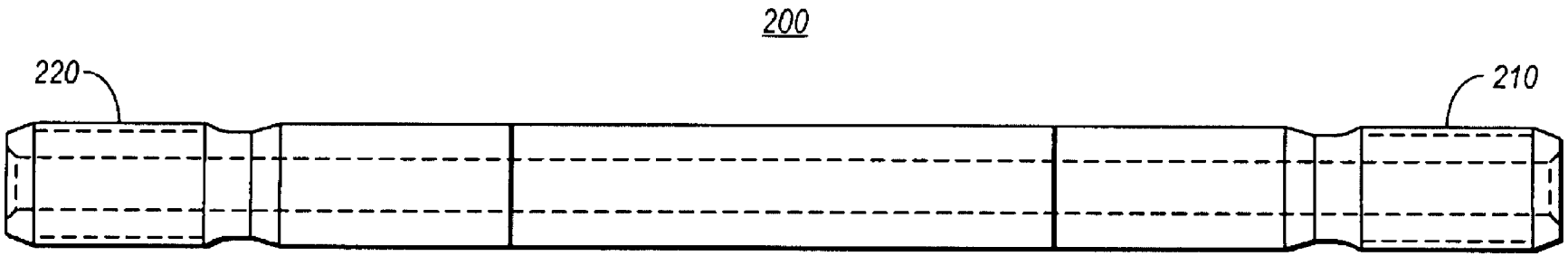
FIG. 5 illustrates a drill rod according to one example.

Reference is now made to FIG. 5, which a drill rod 200 in which the first and second end sections 210 and 220 both include and/or are configured as male adapters for coupling with female adapters of additional drill rods or drill components. Similarly, although FIG. 1 and FIG. 5 illustrate extension rods, the present invention may be employed in manufacturing any drill rods or other drill components known in the art. For example, the present invention may be employed in manufacturing taper rods, tunneling rods, shank adaptors, and the like.

Figure 6:
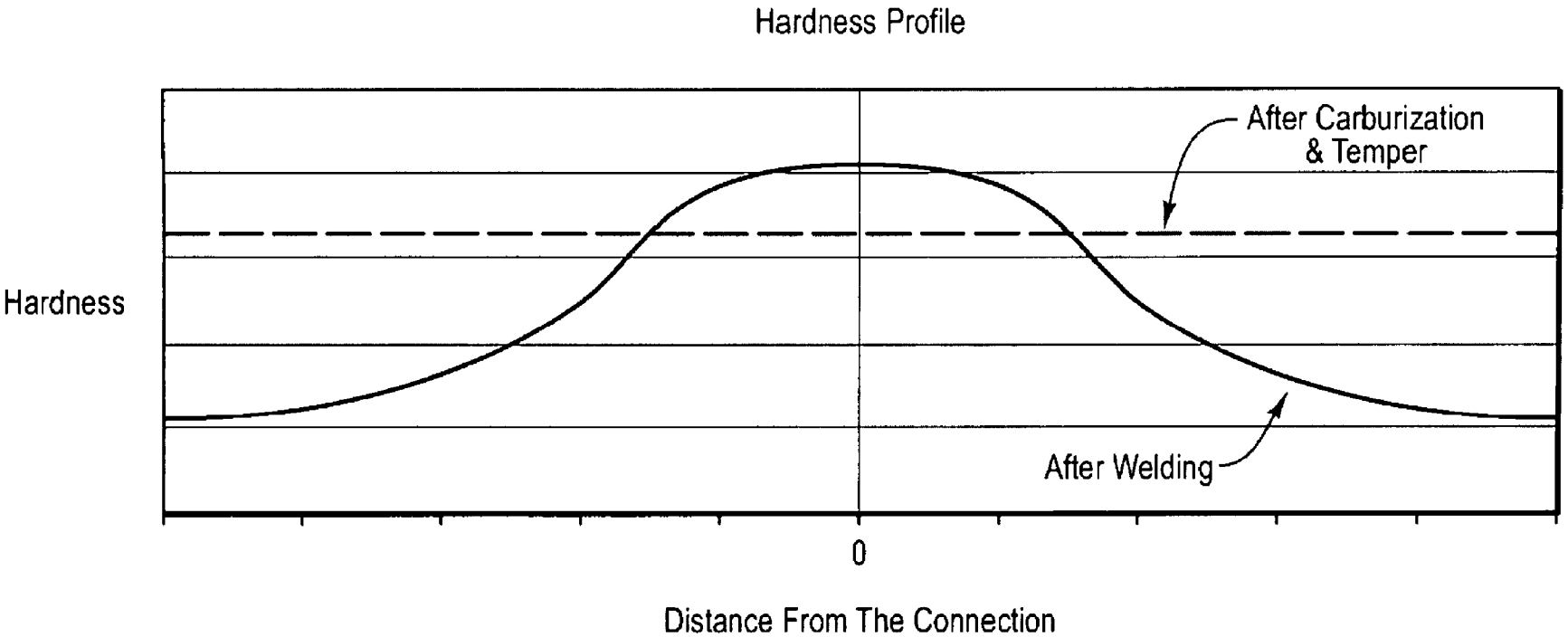
FIG. 6 illustrates a hardness profile of a portion of a drill rod including a connection between a first end section and a mid-section.

Reference is now made to FIG. 6, which illustrates two hardness profiles for the drill rod of the present disclosure, each hardness profile being centered about a connection between a mid-section and a first end section or second end section. The first hardness profile (shown with a solid line) represents the hardness of the drill rod after welding a mid-section to a first end or second end section. The second hardness profile (shown with a dashed line) represents the hardness of the drill rod after carburization and tempering. In one embodiment, the drill rod of the present disclosure can achieve a substantially symmetric hardness profile on both sides of the connection. Accordingly, the drill rod can avoid a substantial increase or decrease in hardness from one section to the next, thereby preventing a weakness or break point at the connection. In one example, the hardness of the mid-section is within two points of the hardness of the first end or second end section based on the Rockwell Hardness C-scale (HRC).

The present disclosure may be embodied in other specific forms without departing from its spirit or essential characteristics. The described examples are to be considered in all respects only as illustrative and not restrictive. The scope of the invention is, therefore, indicated by the appended claims rather than by the foregoing description. All changes which come within the meaning and range of equivalency of the claims are to be embraced within their scope.

I claim:

1. A drill rod comprising:

a first end section comprising non-bainitic steel;

a mid-section having a substantially uniform diameter, wherein the mid-section comprises a bainitic steel; and a joint connecting the first end section to the mid-section, the joint comprising non-bainitic steel material of the first end section directly welded to bainitic material of the mid-section.

2. The drill rod of claim 1, wherein the first end is a bit end.

3. The drill rod of claim 1, wherein the first end is a rig end.

4. The drill rod of claim 1, further comprising a second end section, the second end section being formed of a different material than the mid-section.

5. The drill rod of claim 1, wherein the first end is comprised of a high-grade structural steel.

6. The drill rod of claim 5, wherein the high-grade structural steel includes nickel in a weight percentage not less than 1%.

7. The drill rod of claim 6, wherein the high-grade structural steel is EN27 grade steel.

8. The drill rod of claim 1, wherein the steel used for the mid-section includes nickel in a weight percentage not greater than 0.1%.

9. The drill rod of claim 8, wherein the steel used for the mid-section includes carbon in a weight percentage not greater than 0.22%.

10. The drill rod of claim 5, wherein the steel used for the mid-section includes:

carbon in a weight percentage of 0.16% to 0.22%;

silicon in a weight percentage of 1.1% to 1.4%;

manganese in a weight percentage of 1.9% to 2.3%;

chromium in a weight percentage of 0.8% to 1.1%;

molybdenum in a weight percentage of 0.25% to 0.35%;

phosphorous in a weight percentage not greater than 0.02%;

sulphur in a weight percentage not greater than 0.02%; and copper in a weight percentage not greater than 0.2%.

11. The drill rod of claim 1, wherein the steel used for the mid-section includes:

carbon in a weight percentage of 0.16% to 0.22%;

silicon in a weight percentage of 1.1% to 1.4%;

manganese in a weight percentage of 1.9% to 2.3%;

chromium in a weight percentage of 0.8% to 1.1%;

molybdenum in a weight percentage of 0.25% to 0.35%;

phosphorous in a weight percentage not greater than 0.02%;

sulphur in a weight percentage not greater than 0.02%; and copper in a weight percentage not greater than 0.2%.

12. A method of manufacturing a drill rod, the method comprising:

providing a first end section including a non-bainitic high-grade structural steel;

providing a mid-section including an at least partially bainitic steel; and welding non-bainitic high-grade structural steel material of the first end section directly to bainitic steel material of the mid-section to secure the first end section to the mid-section.

13. The method as recited in claim 12, further comprising carburizing at least the mid-section.

14. The method as recited in claim 13, further comprising carburizing a weld between the first end section and the mid-section.

15. The method as recited in claim 12, wherein the first end section is pre-hardened prior to being joined to the mid-section.

16. The method as recited in claim 12, wherein the first end section is subject to local hardening after being joined to the mid-section.

17. The method as recited in claim 16, wherein the local hardening includes high-frequency induction hardening.

18. The method of claim 12, further comprising:

providing a second end section of the drill rod to be located at the rig end of the drill rod, wherein the second end section is formed from a high-grade structural steel; and joining the second end section to the mid-section.

19. The method as recited in claim 12, wherein welding the first end section to the mid-section comprises a friction welding process.

20. A drill rod comprising:

a first end section formed from a high grade structural steel;

a mid-section connected to the first end section, the mid-section being formed from an at least partially bainitic steel;

a second section connected to the mid-section, the second section being made from a high grade structural steel; and a first weld zone connecting bainitic steel material of the mid-section directly to non-bainitic steel material of the first end section, the first weld zone being at least partially carburized.

21. A drill rod comprising:

a first end section; and a mid-section, wherein the first end section and the mid-section are connected, and wherein the first end section is manufactured using a different steel than is used for the mid-section, wherein the steel used for the mid-section includes: carbon in a weight percentage of 0.16% to 0.22%, silicon in a weight percentage of 1.1% to 1.4%, manganese in a weight percentage of 1.9% to 2.3%, chromium in a weight percentage of 0.8% to 1.1%, molybdenum in a weight percentage of 0.25% to 0.35%, phosphorous in a weight percentage not greater than 0.02%, sulphur in a weight percentage not greater than 0.02%, and copper in a weight percentage not greater than 0.2%.

* * * * *